US006797232B2

(12) United States Patent
Speidel et al.

(10) Patent No.: US 6,797,232 B2
(45) Date of Patent: Sep. 28, 2004

(54) NICKEL-BASED ALLOY FOR HIGH-TEMPERATURE TECHNOLOGY

(75) Inventors: Markus Speidel, Birmenstorf (CH); Josef Bernauer, Kapfenberg (AT)

(73) Assignee: Bohler Edelstahl GmbH, Kapfenberg (AT)

( * ) Notice: Subject to any disclaimer, the term of this patent is extended or adjusted under 35 U.S.C. 154(b) by 0 days.

(21) Appl. No.: 09/880,068

(22) Filed: Jun. 14, 2001

(65) Prior Publication Data

US 2002/0057984 A1 May 16, 2002

(30) Foreign Application Priority Data

Sep. 14, 2000 (AT) ..... 1562/00

(51) Int. Cl.[7] ..... C22C 19/05

(52) U.S. Cl. ..... 420/445; 420/446; 420/447; 420/448; 148/410; 148/428

(58) Field of Search ..... 148/410, 428; 420/446, 447, 448, 445, 452, 453, 454, 459

(56) References Cited

U.S. PATENT DOCUMENTS

| | | | | |
|---|---|---|---|---|
| 4,784,830 A | | 11/1988 | Ganesan | |
| 4,787,945 A | | 11/1988 | Smith et al. | |
| 6,287,398 B1 | * | 9/2001 | Smith et al. | 148/312 |

FOREIGN PATENT DOCUMENTS

| | | | | |
|---|---|---|---|---|
| DE | 4411228 | | 5/1995 | |
| DE | 4411228 | | 10/1995 | |
| EP | 251295 | | 1/1988 | |
| EP | 322156 | | 6/1989 | |
| GB | 810366 | | 3/1959 | |
| JP | 56084445 A | * | 7/1981 | C22C/38/18 |
| JP | 57210941 A | * | 12/1982 | C22C/19/05 |
| JP | 7-316702 | | 12/1995 | |

OTHER PUBLICATIONS

English Language Abstract of 7–316702.
English Language Abstract of DE 4411228 May, 1995.

* cited by examiner

*Primary Examiner*—Roy King
*Assistant Examiner*—Harry D Wilkins, III
(74) *Attorney, Agent, or Firm*—Greenblum & Bernstein, P.L.C.

(57) ABSTRACT

Creep-proof and corrosion-resistant nickel-based alloy for the use in high-temperature technology, comprising in wt-%:

0.0015 to 0.60 carbon (C);

0.20 to 0.90 nitrogen (N);

22.0 to 32.0 chromium (Cr);

5.0 to 20.0 elements of group 4, 5, and 6 of the periodic table, except Cr;

0.03 to 3.0 aluminum (Al);

0.4 to 3.0 silicon (Si);

up to 0.15 elements of group 3 of the periodic table, except actinoids;

up to 0.60 manganese (Ma);

up to 14.8 iron (Fe);

up to 0.01 boron (B);

a maximum of 0.014 phosphorus (P);

a maximum of 0.004 sulfur (S);

a minimum of 51 nickel (Ni) or a combination of nickel (Ni) and cobalt (Co); and melting-related impurities.

31 Claims, No Drawings

NICKEL-BASED ALLOY FOR HIGH-TEMPERATURE TECHNOLOGY

BACKGROUND OF THE INVENTION

1. Field of the Invention

The present invention relates to a creep-proof and corrosion-resistant nickel-based alloy for use in high-temperature technology.

2. Discussion of Background Information

Increasingly, higher mechanical and corrosion chemical demands are placed on metal materials at operational temperatures of more than 900° C., in particular for hot work tools, for components of gas turbines and motors, for elements in oven construction, and in chemical industries. Due to corrosion wear and also in view of the toughness and the creep characteristics of the material, nickel-based alloys containing chromium are well-suited for use at very high temperatures.

A nickel-based alloy with the abbreviation NiCr 7030 according to the DIN material number 2.4658 is considered heat-resistant and is used for heat conductors, oven components, and the like. Although such a material has good oxidation resistance, depending on its silicon and aluminum content, it is also provided with a low toughness and low time yield as well as high creep values at operational temperatures of approximately 1000° C.

A nickel-based alloy that is resistant to high temperatures is known from DE-C-4411228. This high-temperature-resistant, oxidation-resistant, massively nitropenated, hot and cold formable nickel-based alloy is essentially composed of (in mass-%) 0.001 to 0.15 carbon, 0.10 to 3.0 silicon, 25.0 to 30.0 chromium, more than 0.3 to 1.2 nitrogen, 0.001 to 0.01 boron, 0.01 to 0.5 yttrium, cerium, lanthanum, hafnium, and tantalum, alone or in combination, the remainder being nickel with a content of at least 64.0%. Although a mixed crystal hardening can be achieved due to the carbon content, the primarily effective elements of the above-mentioned alloy with regard to the high-temperature characteristics are chromium and nitrogen. Chromium and nitrogen form chromium nitrides which improves creep characteristics, with nitrogen additionally providing a mixed crystal hardening. Considerably improved creep characteristics and heat resistance values seem achievable using the alloy according to DE-C-4411228.

In the temperature range between 900° C. and 1200° C., a so-called creeping of the material during stress and a worsening of corrosion resistance occurs, in particular during cyclic wear, in conventional nickel-based materials, which are exposed to higher wear to an increasing extent. The object of the present invention is to remove these shortcoming and to create an improved nickel-based alloy for high-temperature use.

SUMMARY OF THE INVENTION

The object according to the present invention is attained in a creep-proof and corrosion-resistant nickel-based alloy comprising in wt-%:

0.0015 to 0.60 carbon (C)

0.20 to 0.90 nitrogen (N)

22.0 to 32.0 chromium (Cr)

5.0 to 20.0 elements of group 4, 5, and 6 of the periodic table, except Cr 0.03 to 3.0 aluminum (Al)

0.4 to 3.0 silicon (Si)

up to 0.15 elements of group 3 of the periodic table, except actinoids up to 0.60 manganese (Mn)

up to 14.8 iron (Fe)

up to 0.01 boron (B)

a maximum of 0.014 phosphorus (P)

a maximum of 0.004 sulfur (S)

a minimum of 51 nickel (Ni) or a combination of nickel (Ni) and cobalt (Co) and melting-related impurities.

Thus, the present invention is directed to a creep-proof and corrosion-resistant nickel-based alloy for the use in high-temperature technology comprising, in wt-%:

0.0015 to 0.60 carbon (C);

0.20 to 0.90 nitrogen (N);

22.0 to 32.0 chromium (Cr);

5.0 to 20.0 elements of the groups 4, 5, and 6 of the periodic table, except Cr;

0.03 to 3.0 aluminum (Al);

0.4 to 3.0 silicon (Si);

maximum of 0.014 phosphorus (P);

maximum of 0.004 sulfur (S);

minimum of 51 of nickel (Ni) or a combination of nickel (Ni) and cobalt (Co); and melting-related contaminants.

The carbon can be present in 0.16 to 0.5 wt-%.

The ratio of nitrogen to carbon can be 0.5 to 5.5, preferably 1 to 4, and optionally 1 to 3.

The nickel-based alloy can contain a total concentration of molybdenum (Mo) and tungsten (W), in wt-%, according to the following formula:

$$Mo+W/2=3.0 \text{ to } 10.0, \text{ preferably } 4.0 \text{ to } 8.0.$$

The Cr can be present in 25.0 to 30.0 wt-%.

The Si can be present in 0.5 to 1.0 wt-%.

The nickel based-alloy can comprise at least one element of Group 3 of the periodic table, except actinoids, the at least one element being present up to 0.15 wt-%, preferably 0.01 to 0.12; manganese (Mn), the Mn being present up to 0.60 wt-%; iron (Fe), the Fe being present up to 14.8 wt-%; and/or comprising boron (B), the B being present up to 0.01 wt-%.

DETAILED DESCRIPTION OF THE PRESENT INVENTION

The advantages achieved according to the invention are essentially based on the fact that, at temperatures of up to 1200° C., intercrystalline creeping in the material is largely prevented due to stable deposits in the intercrystalline regions and an increased mixed crystal hardening is achieved. Additionally, the adhesion of chromium spinel and such layers to the surface is increased, causing an improved high-temperature corrosion resistance of the components.

The effect and the reciprocal effect of the elements of the nickel-based alloy according to the invention shall be described in greater detail in the following.

The elements of groups 4, 5, and 6 (except chromium), essentially being titanium (Ti), zirconium (Zr), hafnium (Hf), vanadium (V), niobium (Nb), tantalum (Ta), molybdenum (Mo), and tungsten (W) have a mixed crystal hardening effect and are provided with different activities regarding the non-metal elements carbon and nitrogen. Ta and Nb, for example, form thermally highly stable nitrides, the nitrogen affinity of strong carbide formers Mo and W are low, however. It has been shown that the elements of groups 4, 5, and 6 (except Cr) with a concentration of at least 5 but not more than 20 wt-% in the material are partially embedded in the atomic grid of the matrix in a toughness-increasing manner and partially form nitride and/or carbon nitride dispersion, which increase the intercrystalline stability and, thus, make more difficult intercrystalline creeping at temperatures above 1000° C. Additionally, under such conditions, the dispersion effectively prevents a grain increase.

Here, the extent of the mixed crystal hardening can be adjusted by the content of carbon and the content of strong carbide formers. For example, if the carbon content of the alloy is low, strong carbide-forming elements are increasingly embedded in the crystal grid of the mixed crystals and brace them.

A further deciding advantage of the alloy according to the invention is the fact that the above-listed elements, in particular the elements Mo and W, shift the peritectic transformation of the II phase to higher temperatures by substitution of Cr atoms and, thus, a stabilization of II deposits is caused under operating conditions. A transformation occurring during a rising temperature of approximately 1000° C.

$$\gamma+\pi\rightarrow\gamma+\epsilon \text{ corresponding to } \gamma+Cr_{13}Ni_7N_4\rightarrow\gamma+Cr_2N$$

in Ni—Cr—N alloys which correspond to a change in volume of approximately $1\times10^{-3}$%, is increased to a temperature of more than 1210° C. by a Mo concentration of 4 wt-%, for instance, as may be seen in Table 1. Due to the addition of Mo, for example, no changes in volume occur even at high operating temperatures in a cyclic temperature impact and material wear, resulting in an improvement of the high-temperature corrosion resistance since no cause for peeling of parts of the chromium-spinel surface layer is present.

Carbon with a content of more than 0.0015 wt-% enhances the formation of nitride and carbon nitride; however, at a content of more than 0.6 wt-% in the alloy, it removes too large an amount of carbide-forming elements, thereby counteracting the matrix hardening. A carbon content of 0.16 to 0.5 wt-% is preferred.

When, in an advantageous manner, the ratio value of nitrogen to carbon content in the alloy is in the region of 0.5 to 5.5, preferably 1.0 to 4.0, optionally 1.0 to 3.0, particularly effective and stable carbon nitride deposits are formed and an efficient mixed crystal hardening is achieved.

In order to achieve a II phase as stable as possible during high modification temperatures of the material and, simultaneously, an effective mixed crystal hardening as well, it is advantageous for the nickel-based alloy to be provided with a total concentration of molybdenum and tungsten in wt-% according to the formula $$Mo+W/2=3.0 \text{ to } 10, \text{ preferably } 4.0 \text{ to } 8.0.$$

Chromium contents in wt-% of 25 to 30 are preferred. In order to minimize the high-temperature corrosion, it is important for the material to contain at least 0.03 wt-% Al and at least 0.4 wt-% Si. Contents higher than 3.0 wt-% lead to a disadvantageous deposit characteristic, stress fractures, and the formation of coarse grains and contents higher than 3.0% of Si worsen the heat forming ability of the alloy.

The corrosion resistance at high temperatures can be increased when the material is alloyed with elements of group 3 of the periodic table, i.e., scandium (Sc), Yttrium (Y), lanthanum (La), and lantanides up to a concentration of 0.15 wt-%. Here, contents between 0.01 and 0.12 wt-% are preferred.

The invention shall be explained in greater detail in the following.

Nickel-based alloys with a composition according to the invention can be produced by means of pressure metallurgy in which the liquid melt is kept under a constant high pressure until it hardens (e.g., DESU-process) or by powder metallurgy. When PM technology is used, first a metal power having the desired content of metal elements is produced, this powder is subsequently stacked over the gaseous phase at a raised temperature and subjected to hot isostatic pressing.

Forming of the casted or sintered blocks usually occurs subsequent to a homogenization of the material at 1250° C. during a forming at 1200° C. Here, grain sizes of 35 to 80 μm and nickel deposits with a diameter of 1 to 5 μm are produced in the material.

As previously mentioned, the transformation temperature of the II phase is increased by the presence of elements of group 4, 5, and 6 (except Cr). Table 1 shows the dissolution and formation temperatures that were determined and the compositions of the II phase and those of the mixed crystal for a Ni—Cr—N alloy free of Mo, and for such alloys having a Mo content of 4 to 8 wt-% as well as one having 4 wt-% W. For concentrations of 8 wt-% Mo and 0.7 wt-% N, both temperature values for a transformation π-ε are greater than 1300° C.

Here, the II phase is provided with a reduced chromium content of 45 wt-% at a concentration of molybdenum of 11 wt-%. The γ mixed crystal has increased chromium values of 29 wt-% and a content of molybdenum of 6.5 wt-% at a decreased nickel concentration.

TABLE 1

Influence of the content of molybdenum and tungsten onto the interval of the modification temperature ΔT (dilatometer examination) of γ + $Cr_2N$.

| Chemical composition [wt - %] | Ni 30Cr 0.9N | Ni 30Cr 4W 0.7N | Ni 30Cr 4Mo 0.7N | Ni 30Cr 8Mo 0.7N |
|---|---|---|---|---|
| ΔT (heating) | 1120–1185° C. | 1160–1180° C. | 1210–1280° C. | >1300° C. |
| ΔT (cooling) | 1180–1195° C. | 1180–1240° C. | 1260–1280° C. | >1300° C. |
| π-phase composition [wt - %] | 42 Ni<br>58 Cr | 41 Ni<br>53 Cr<br>4.5 W | 41 Ni<br>51 Cr<br>8 Mo | 43 Ni<br>45 Cr<br>11 Mo |
| γ-matrix composition [wt %] | 77 Ni<br>23 Cr | 68 Ni<br>26 Cr<br>5 W | 69 Ni<br>28 Cr<br>3.5 Mo | 65 Ni<br>29 Cr<br>6.5 Mo |

Table 2 shows the chemical composition of the alloys according to the invention (alloys 1 through 5) and reference alloys (alloys 6 through 9).

Table 3 lists the mechanical characteristics of the alloys at 800° C., at 1000° C., and at 1100° C.

When compared, it is discernible that the 0.2% yield stress (Rp0.2) of the material is considerably increased by the alloy technology measures according to the invention and the breaking strain (A) each is provided with lower values. In particular, the creep resistance at 1% stretching of the nickel-based alloy according to the invention is considerably improved in reference to prior art.

The resistance to high-temperature corrosion is improved in the alloys according to the invention by approximately 16% (alloy 3 by more than 22%) in reference to prior art.

TABLE 2

| Alloy | C [%] | Si [%] | Mn [%] | Cr [%] | Mo [%] | Ni [%] | W [%] | Co [%] | N [%] | Al [%] | B [%] | Fe [%] | Nb+Ta [%] | Ce+La [%] |
|---|---|---|---|---|---|---|---|---|---|---|---|---|---|---|
| Alloy 1 | 0.07 | 0.4 | 0.1 | 25.4 | — | bal. | 8.8 | 10.3 | 0.22 | 0.6 | 0.001 | 0.3 | — | 0.096 |
| Alloy 2 | 0.05 | 0.8 | 0.2 | 24.2 | 2.4 | bal. | 6.3 | 0.3 | 0.54 | 0.5 | 0.001 | 5.2 | 1.4 | 0.015 |
| Alloy 3 | 0.25 | 2.2 | 0.1 | 30.1 | — | bal. | 10.2 | 0.2 | 0.28 | 1.7 | 0.002 | 0.2 | — | 0.138 |
| Alloy 4 | 0.12 | 0.5 | 0.1 | 26.7 | — | bal. | 11.3 | 0.1 | 0.44 | 0.3 | 0.003 | 0.2 | 0.8 | 0.020 |
| Alloy 5 | 0.08 | 0.9 | 0.2 | 28.3 | 5.6 | bal. | 12.5 | 0.3 | 0.60 | 0.2 | 0.002 | 0.1 | — | 0.047 |
| Alloy 6 | 0.07 | 0.2 | 0.1 | 15.4 | — | bal. | — | 0.2 | — | 0.2 | 0.001 | 8.8 | — | — |
| Alloy 7 | 0.03 | 0.1 | 0.2 | 21.6 | 8.8 | bal. | — | 0.1 | — | 0.2 | 0.002 | 0.4 | 3.7 | 0.003 |
| Alloy 8 | 0.02 | 0.8 | 0.2 | 31.5 | — | bal. | — | 0.3 | 0.48 | 0.1 | 0.002 | 0.1 | — | — |
| Alloy 9 | 0.10 | 0.4 | 0.2 | 22.1 | 2.3 | bal. | 13.7 | 0.1 | — | 0.3 | 0.001 | 0.2 | — | 0.008 |

TABLE 3

| Alloy | Rp0.2 800° C. [MPa] | Breaking strain at 800° C. [%] | Rp0.2 1000° C. [MPa] | Breaking strain at 1000° C. [%] | Rp 1% stretch. 1000° C. 500h | Rp0.2 1100° C. [MPa] | Breaking strain A at 1100° C. [%] | Rp 1% Stretch. 1100° C. 500 h |
|---|---|---|---|---|---|---|---|---|
| Alloy 1 | 315 | 21 | 156 | 21 | 20 MPa | 71 | 40 | 10 MPa |
| Alloy 2 | 302 | 18 | 130 | 34 | 20 MPa | 85 | 49 | 12 MPa |
| Alloy 3 | 391 | 25 | 125 | 25 | 18 MPa | 76 | 32 | 10 MPa |
| Alloy 4 | 394 | 19 | 142 | 18 | 22 MPa | 82 | 35 | 12 MPa |
| Alloy 5 | 375 | 20 | 152 | 24 | 22 MPa | 95 | 42 | 14 MPa |
| Alloy 6 | 102 | 56 | 26 | 115 | 8 MPa | 14 | 110 | 4 MPa |
| Alloy 7 | 235 | 96 | 98 | 110 | 13 MPa | 46 | 132 | 6 MPa |
| Alloy 8 | 285 | 20 | 80 | 25 | 12 MPa | 51 | 48 | 8 MPa |
| Alloy 9 | 270 | 57 | 120 | 83 | 17 MPa | 65 | 82 | 8 MPa |

What is claimed is:

1. Creep-proof and corrosion-resistant nickel-based alloy comprising, in wt-%:

0.0015 to 0.60 carbon (C);

0.20 to 0.90 nitrogen (N);

22.0 to 32.0 chromium (Cr);

5.0 to 20.0 elements of the groups 4, 5, and 6 of the periodic table, except Cr;

0.03 to 3.0 aluminum (Al);

0.4 to 3.0 silicon (Si);

maximum of 0.014 phosphorus (P); maximum of 0.004 sulfur (S);

up to 0.60 manganese (Mn);

minimum of 51 of nickel (Ni) or a combination of nickel (Ni) and cobalt (Co); and melting-related contaminants, and the alloy including at least one of nitrides or carbides in intercrystalline regions to substantially prevent intercrystalline sliding due to stable deposits in the intercrystalline regions.

2. Nickel-based alloy according to claim 1, comprising, in wt-%, 0.16 to 0.5 C.

3. Nickel-based alloy according to claim 1, comprising a ratio of nitrogen to carbon of 0.5 to 5.5.

4. Nickel-based alloy according to claim 3, wherein the ratio of nitrogen to carbon is 1 to 4.

5. Nickel-based alloy according to claim 3, wherein the ratio of nitrogen to carbon is 1 to 3.

6. Nickel-based alloy according to claim 1, comprising a total concentration of molybdenum (Mo) and tungsten (W), in wt-%, according to the following a formula:

$$Mo+W/2=3.0 \text{ to } 1.0.$$

7. Nickel-based alloy according to claim 6, comprising a total concentration of molybdenum (Mo) and tungsten (W), in wt-%, according to the following formula:

$$Mo+W/2=4.0 \text{ to } 8.0.$$

8. Nickel-based alloy according to claim 1, comprising, in wt-%, 25.0 to 30.0 Cr.

9. Nickel-based alloy according to claim 1, comprising, in wt-%, 0.5 to 1.0 Si.

10. Nickel based-alloy according to claim 1, comprising at least one element of Group 3 of the periodic table, except actinoids, said at least one element being present up to 0.15 wt-%.

11. Nickel-based alloy according to claim 10, comprising, in wt-%, 0.01 to 0.12 of at least one element of Group 3 of the periodic table, except actinoids.

12. Nickel based-alloy according to claim 1, comprising manganese (Mn), said Mn being present up to 0.60 wt-%.

13. Nickel based-alloy according to claim 1, comprising iron (Fe), said Fe being present up to 14.8 wt-%.

14. Nickel based-alloy according to claim 1, comprising boron (B), said B being present up to 0.01 wt-%.

15. Nickel based-alloy according to claim 1, comprising at least one element of Group 3 of the periodic table, except actinoids, said at least one element being present up to 0.15 wt-%; comprising manganese (Mn), said Mn being present up to 0.60 wt-%; comprising iron (Fe), said Fe being present up to 14.8 wt-%; and comprising boron (B), said B being present up to 0.01 wt-%.

16. Nickel based-alloy according to claim 1, comprising at least one element of Group 3 of the periodic table, except actinoids, said at least one element being present up to 0.15 wt-%; comprising manganese (Mn), said Mn being present up to 0.60 wt-%; and comprising iron (Fe), said Fe being present up to 14.8 wt-%.

17. Nickel based-alloy according to claim 1, comprising at least one element of Group 3 of the periodic table, except actinoids, said at least one element being present up to 0.15 wt-%; comprising manganese (Mn), said Mn being present up to 0.60 wt-%; and comprising boron (B), said B being present up to 0.01 wt-%.

18. Nickel based-alloy according to claim 1, comprising at least one element of Group 3 of the periodic table, except actinoids, said at least one element being present up to 0.15 wt-%; comprising iron (Fe), said Fe being present up to 14.8 wt-%; and comprising boron (B), said B being present up to 0.01 wt-%.

19. Nickel based-alloy according to claim 1, comprising manganese (Mn), said Mn being present up to 0.60 wt-%; comprising iron (Fe), said Fe being present up to 14.8 wt-%; and comprising boron (B), said B being present up to 0.01 wt-%.

20. Nickel based-alloy according to claim 1, comprising at least one element of Group 3 of the periodic table, except actinoids, said at least one element being present up to 0.15 wt-%; and comprising manganese (Mn), said Mn being present up to 0.60 wt-%.

21. Nickel based-alloy according to claim 1, comprising at least one element of Group 3 of the periodic table, except actinoids, said at least one element being present up to 0.15 wt-%; and comprising iron (Fe), said Fe being present up to 14.8 wt-%.

22. Nickel based-alloy according to claim 1, comprising at least one element of Group 3 of the periodic table, except actinoids, said at least one element being present up to 0.15 wt-%; and comprising boron (B), said B being present up to 0.01 wt-%.

23. Nickel based-alloy according to claim 1, comprising manganese (Mn), said Mn being present up to 0.60 wt-%; and comprising iron (Fe), said Fe being present up to 14.8 wt-%.

24. Nickel based-alloy according to claim 1, comprising manganese (Mn), said Mn being present up to 0.60 wt-%; and comprising boron (B), said B being present up to 0.01 wt-%.

25. Nickel based-alloy according to claim 1, comprising iron (Fe), said Fe being present up to 14.8 wt-%; and comprising boron (B), said B being present up to 0.01 wt-%.

26. Creep-proof and corrosion-resistant nickel-based alloy consisting essentially of, in wt-%:

0.0015 to 0.60 carbon (C);

0.20 to 0.90 nitrogen (N);

22.0 to 32.0 chromium (Cr);

5.0 to 20.0 elements of the groups 4, 5, and 6 of the periodic table, except Cr;

0.03 to 3.0 aluminum (Al);

0.4 to 3.0 silicon (Si);

maximum of 0.014 phosphorus (P);

maximum of 0.004 sulfur (S);

up to 0.15 of at least one element of Group 3 of the periodic table, except actinoids;

up to 0.60 manganese (Mn);

up to 14.8 iron (Fe);

up to 0.01 (B);

minimum of 51 of nickel (Ni) or a combination of nickel (Ni) and cobalt (Co); and melting-related contaminants, and the alloy including at least one of nitrides or carbides in intercrystalline regions to substantially prevent intercrystalline sliding due to stable deposits in the intercrystalline regions.

27. Nickel-based alloy according to claim 26, comprising a total concentration of molybdenum (Mo) and tungsten (W), in wt-%, according to the following formula:

$$Mo+W/2=3.0 \text{ to } 10.0.$$

28. Nickel based-alloy according to claim 26, comprising at least one element of Group 3 of the periodic table, except actinoids, said at least one element being present up to 0.15 wt-%; comprising manganese (Mn), said Mn being present up to 0.60 wt-%; comprising iron (Fe), said Fe being present up to 14.8 wt-%; and comprising boron (B), said B being present up to 0.01 wt-%.

29. Nickel based-alloy according to claim 26, comprising at least one element of Group 3 of the periodic table, except actinoids, said at least one element being present up to 0.15 wt-%; comprising manganese (Mn), said Mn being present up to 0.60 wt-%; and comprising boron (B), said B being present up to 0.01 wt-%.

30. Nickel based-alloy according to claim 26, comprising manganese (Mn), said Mn being present up to 0.60 wt-%; and comprising boron (B), said B being present up to 0.01 wt-%.

31. Nickel based-alloy according to claim 26, comprising iron (Fe), said Fe being present up to 14.8 wt-%; and comprising boron (B), said B being present up to 0.01 wt-%.

* * * * *